US007757689B2

(12) United States Patent
Chang

(10) Patent No.: US 7,757,689 B2
(45) Date of Patent: Jul. 20, 2010

(54) INFLATABLE ISOLATING CABIN

(75) Inventor: Wang-Hsing Chang, Taipei (TW)

(73) Assignee: Krystal Star International Corporation, Taipei (TW)

( * ) Notice: Subject to any disclaimer, the term of this patent is extended or adjusted under 35 U.S.C. 154(b) by 795 days.

(21) Appl. No.: 11/488,735

(22) Filed: Jul. 19, 2006

(65) Prior Publication Data

US 2008/0020695 A1 Jan. 24, 2008

(51) Int. Cl.
*A61G 10/00* (2006.01)

(52) U.S. Cl. ..... 128/202.12; 128/200.24; 128/205.26; 128/205.28; 128/202.13; 128/202.14; 600/21; 600/22; 312/209

(58) Field of Classification Search ..... 128/200.24, 128/205.26, 205.28, 202.12, 202.13, 202.14, 128/745, 846, 201.27, 202.22; 600/21, 22; 312/209

See application file for complete search history.

(56) References Cited

U.S. PATENT DOCUMENTS 7,503,890 B2 * 3/2009 Kubicsko et al. ..... 600/21
2008/0006272 A1 * 1/2008 Lewis ..... 128/205.26

* cited by examiner

*Primary Examiner*—Patricia Bianco
*Assistant Examiner*—Nihir Patel
(74) *Attorney, Agent, or Firm*—Muncy, Geissler, Olds & Lowe, PLLC

(57) ABSTRACT

An inflatable isolating cabin is provided for a patient to be isolated, and especially for a patient to be moved or transported, and the cabin can be formed after being inflated and collapsed into a solid form convenient for storage. It comprises a very tough and soft base, a flexible outer hood, an inflatable supporting structure, and a filtering means. Wherein a part of the periphery of the outer hood is fixedly connected with the base, and the other part is detachably connected with the base; the inflatable supporting structure is provided with at least one inflation inlet hole and after the inflation of the supporting structure, the outer hood is unfolded away from the base to form the cabin to allow a patient to lie therein.

12 Claims, 7 Drawing Sheets

INFLATABLE ISOLATING CABIN

BACKGROUND OF THE INVENTION

1. Field of the Invention

The present invention is related to an inflatable isolating cabin, and especially to one with an inflatable supporting structure, to be used for highly infectious and contaminative patients.

2. Description of the Prior Art

Conventional isolating cabins generally are divided into three kinds: the first kind is an isolating cabin with an external fixing hood (such as an acryl hood), this kind of isolating cabins is very expensive and is so bulky that it is difficult for carrying and is unsuitable for using as a movable isolating cabin; the second kind is an isolating cabin with supporting stands, and the main body of the isolating cabin has on its base a peripheral frame made of aluminum alloy and the frame has the supporting stands on its front and rear ends to support an outer hood, although its price and weight have been lowered a lot, it is still expensive and not light by weight. Moreover, there is also a defect that the supporting stands may hinder moving in and out of a person to be isolated. The third kind is an isolating cabin with no support, such as those nuclear-biological-chemical protection cabins used by the North Atlantic Treaty Organization, although such an isolating cabin can meet requirements in price and weight, the strength of supporting is weak and the isolating cabin will be useless when it bears a pressure.

SUMMARY OF THE INVENTION

One objective of the present invention is to provide an inflatable isolating cabin used for a patient to be isolated in transportation for medical treatment.

Another objective of the present invention is to provide an inflatable isolating cabin that is structurally simple and inexpensive.

Still another objective of the present invention is to provide an inflatable isolating cabin that is easy for carrying and can be used outdoors.

To achieve the objectives above, the inflatable isolating cabin of the present invention can be inflated to form a cabin, and can be deflated into a solid form convenient for storage. It comprises a very tough and soft base, a flexible outer hood, an inflatable supporting structure and a filtering means. Wherein the flexible outer hood is provided with at least one air exhausting hole and with at least one air inlet hole; a part of the periphery of the outer hood is fixedly connected with the base, and the other part is detachably connected with the base; the inflatable supporting structure is connected with the inner side of the outer hood, and is provided with at least one inflation inlet hole in order that after inflation of the supporting structure, the outer hood is unfolded away from the base to form the cabin; the filtering means includes an electric air pump and at least one toxicant-filtering can that is tightly connected with an air exhausting hole for filtering toxic gas that is exhausted from the isolating cabin.

The present invention will be apparent after reading the detailed description of the preferred embodiment in reference to the accompanying drawings.

DETAILED DESCRIPTION OF THE PREFERRED EMBODIMENT

Figure 1:
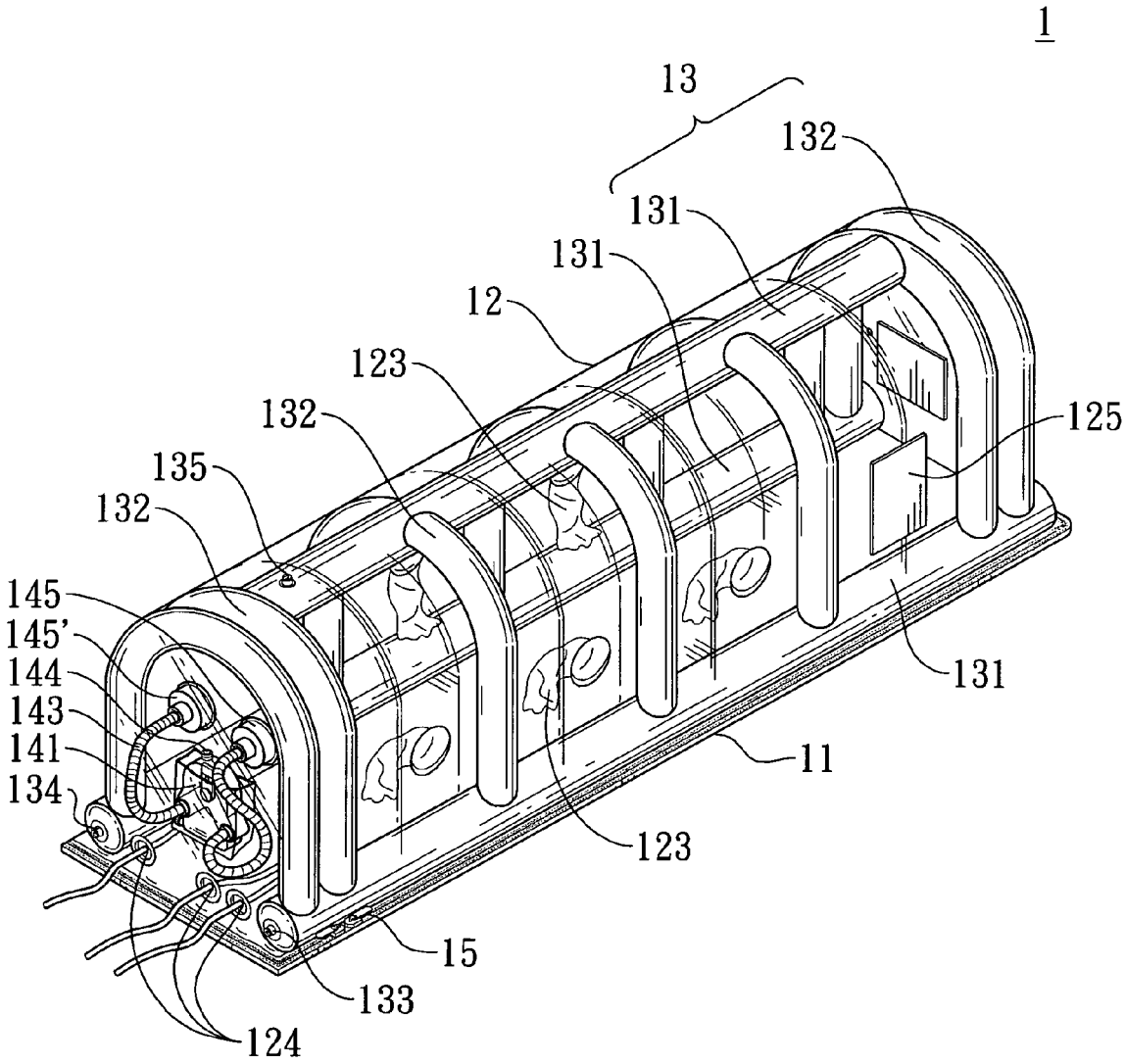
FIG. 1 is a perspective view of a preferred embodiment of the present invention.
Figure 2:
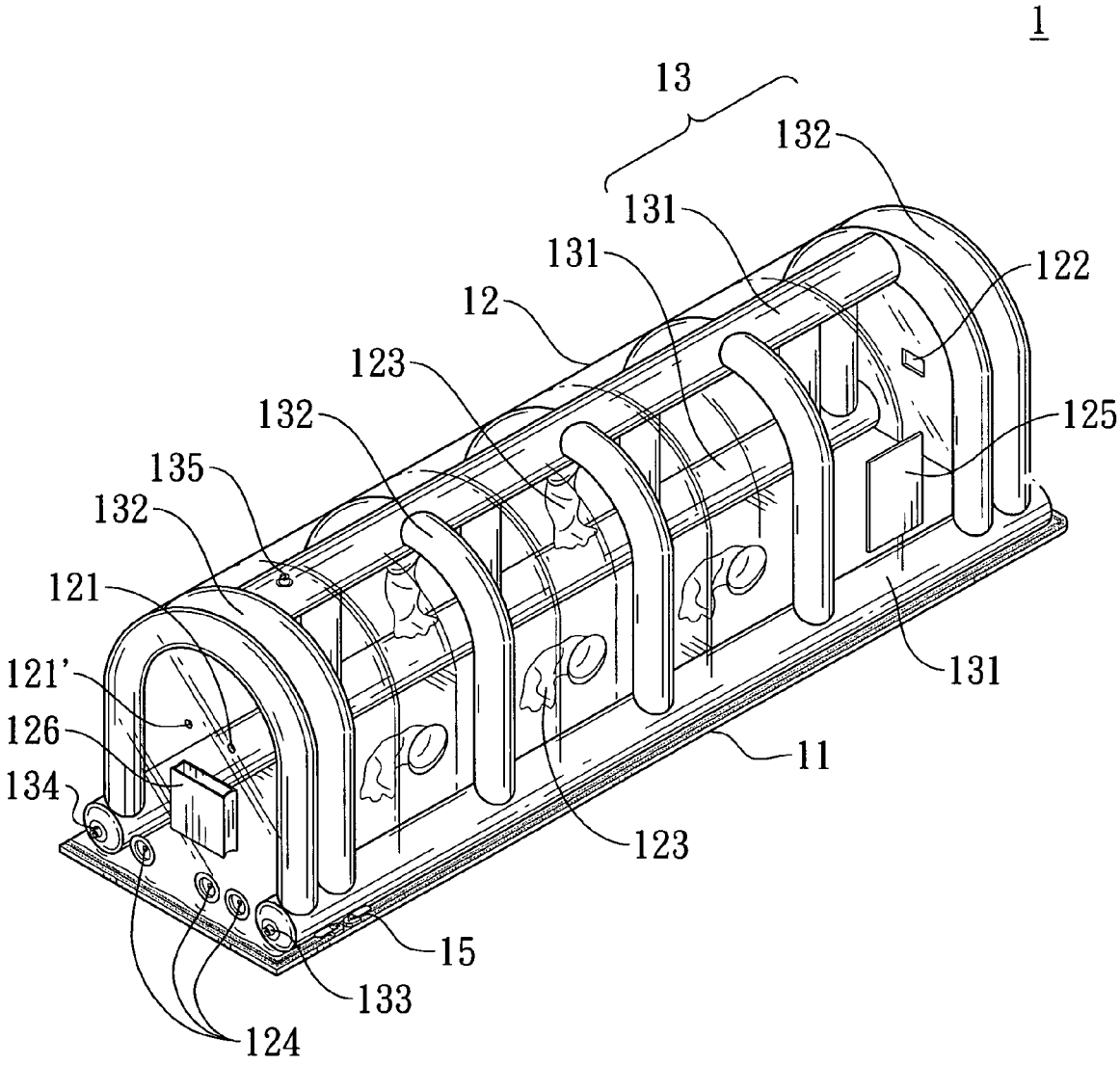
FIG. 2 is a perspective view of the preferred embodiment of the present invention before installing a filtering means.

Referring to FIGS. 1 and 2, the inflatable isolating cabin 1 of the present invention mainly comprises a very tough and soft base 11, a flexible outer hood 12, an inflatable supporting structure 13 and a filtering means 14. The base 11 is made of very tough canvas; the flexible outer hood 12 is made of transparent and flexible plastic, and is provided with two air exhausting holes 121, 121', an air inlet hole 122 and a receiving bag 126; each of the air exhausting holes 121, 121' is connected with a toxicant filtering can 145 (145'), and the air inlet hole 122 is connected with a filter net 146; one side of the periphery of the outer hood 12 is fixedly connected with the base 11, and the remaining three sides of the periphery of the outer hood 12 are detachably connected with the base 11 by using an airtight zipper 15, so the zipper 15 can open the outer hood 12, and the zipper 15 can be closed after a patient is placed in. The inflatable supporting structure 13 is connected with the inner side of the outer hood 12, and it is composed of three hollow transverse beams 131 and seven reverse "U"-shaped hollow posts 132, wherein the two reverse "U"-shaped posts 132 at the head end of the outer hood 12 and a bottom transverse beam 131 form an inflatable air chamber, while the two reverse "U"-shaped posts 132 at the tailing end of the outer hood 12 and another bottom transverse beam 131 form another inflatable air chamber, and the three reverse "U"-shaped posts 132 in the middle of the outer hood 12 and a transverse beam 131 connected with the three reverse "U"-shaped posts 132 form another inflatable air chamber. The three air chambers have inflation inlet ports 133, 134 or 135 respectively, and after the inflation of the supporting structure 13, the outer hood 12 is unfolded away from the base 11 to form the cabin 1 for a patient to lie therein; if there is any leakage in the air chambers, the inflatable supporting structure 13 will not collapse.

Figure 3:
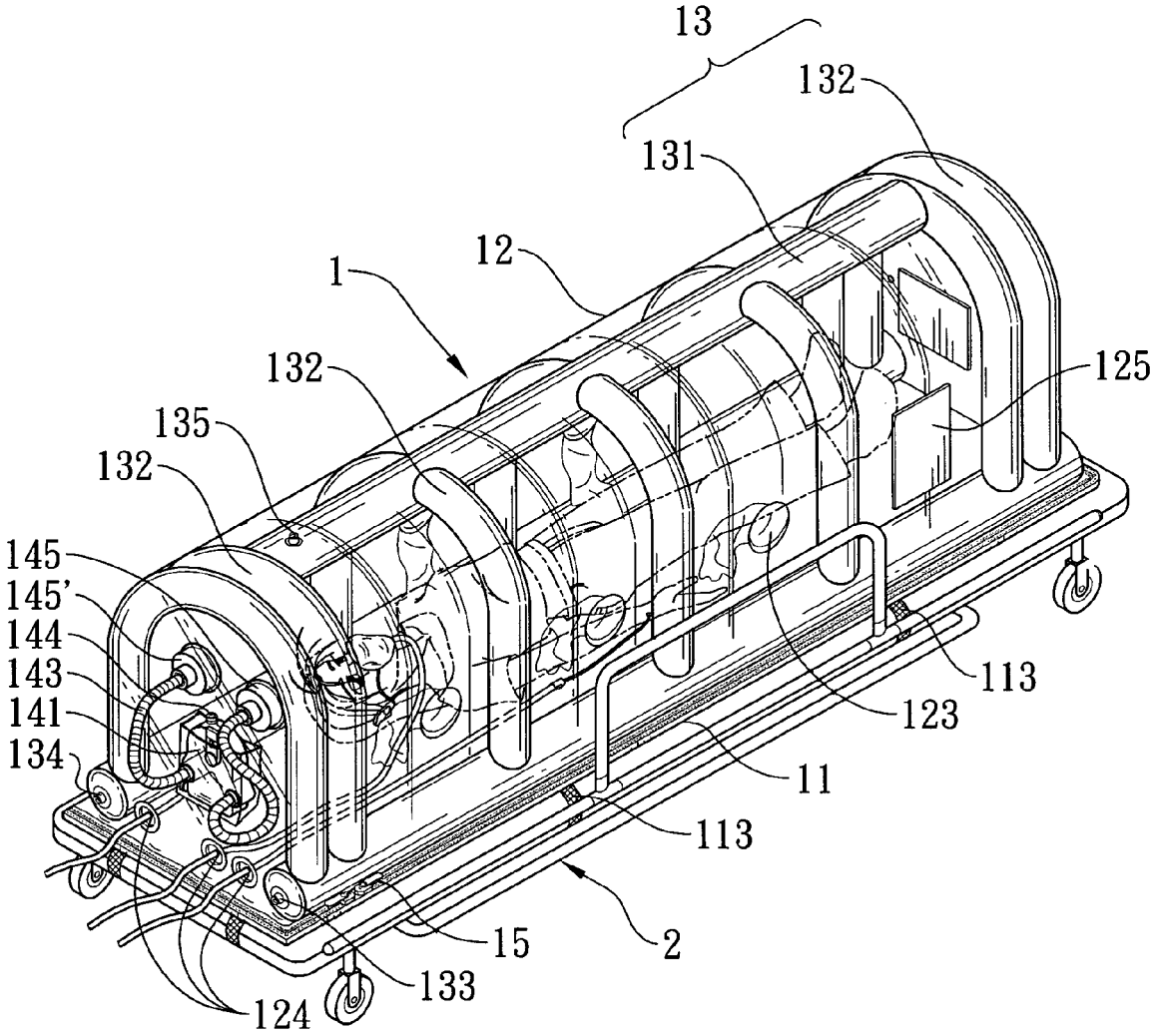
FIG. 3 is a perspective view of the preferred embodiment of the present invention under the condition of medical treating.
Figure 4:
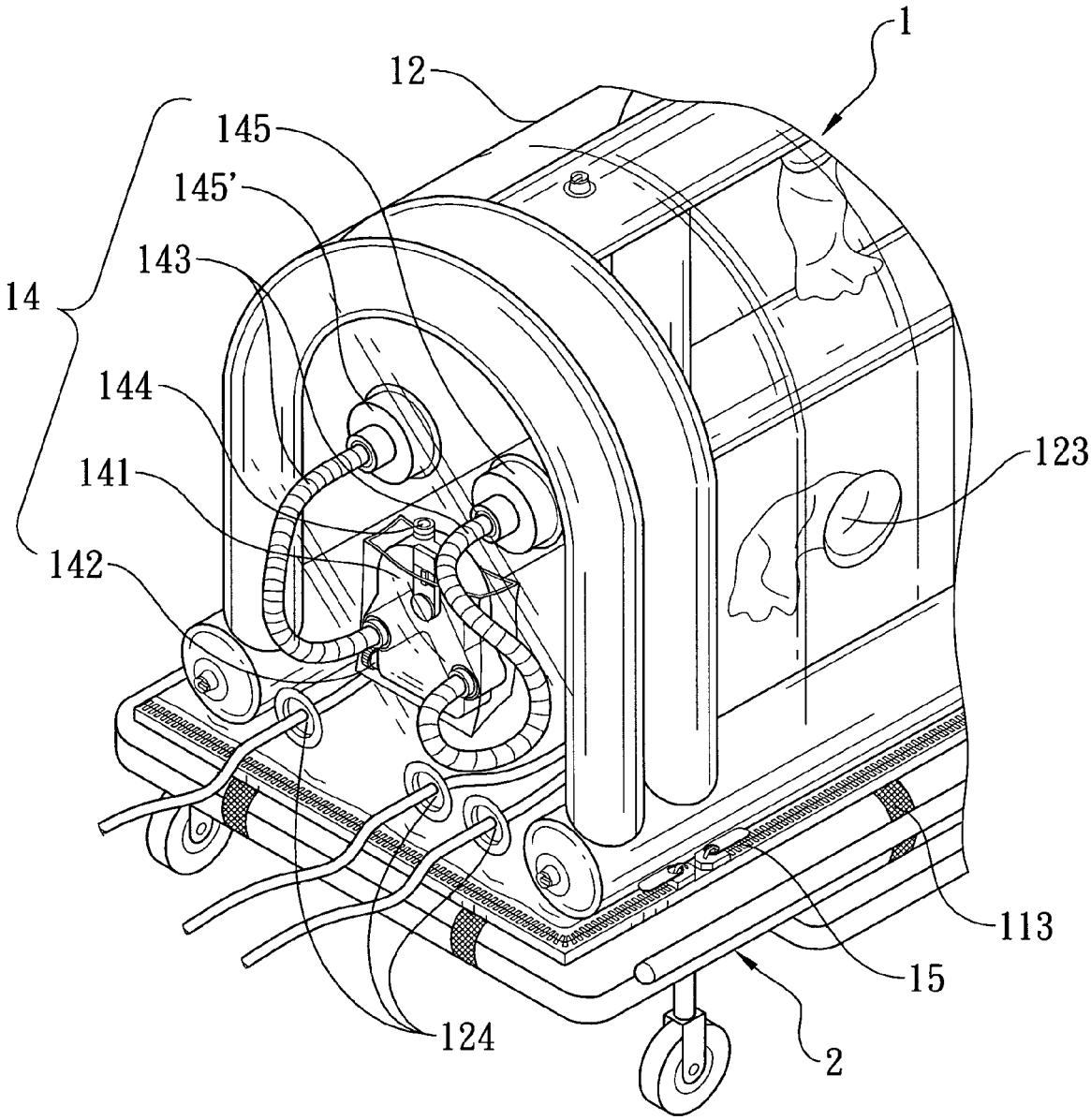
FIG. 4 is an enlarged partial perspective view of the preferred embodiment of the present invention showing the filtering means.

Referring to FIGS. 3 and 4, the filtering means 14 includes an electric air pump 141 and two toxicant-filtering cans 145, 145'; the electric air pump 141 can be received in the receiving bag 126 and has two air drawing tubes 143, 143', a chargeable battery 142, an electric plug (not shown), and an air exhausting port 144. The chargeable battery 142 and the electric plug both can supply electric power for operating the filtering means 14; the two air drawing tubes 143, 143' are respectively connected to the toxicant-filtering cans 145, 145' that are connected with air exhausting holes 121, 121' of the outer hood 12 to draw out harmful air in the isolating cabin 1 and exhaust clean air out of the air exhausting port 144. The two toxicant-filtering cans 145, 145' meet the military standard in filtering virus or other toxic substances, and they are also connected with the filter net 146 of the air inlet hole 122 of the outer hood 12 to further make safe the air entering the isolating cabin 1, and thereby, the filtering means 14 can generate negative pressure in the inflatable isolating cabin 1, and can keep the air flow fluent in the isolating cabin 1.

For the purpose of rendering the medical staffs able to do medical treatment for a patient in the isolating cabin 1, the isolating cabin 1 is provided on the outer hood 12 with a plurality of recessed portions 123 extending into the isolating cabin 1, and the recessed portions 123 are in the form of gloves for the convenience of stretching hands into the glove-shaped recessed portions 123 to do medical treatment for the patient indirectly. The outer hood 12 is further provided with a plurality of connecting holes 124 for connecting medical pipes and lines such as an oxygen pipe and a dripping pipe into the isolating cabin 1, and the connecting holes 124 can be closed when not in use.

The outer hood 12 is provided on its outer surface with a receiving bag 125 for holding medical records, and the receiving bag 125 for holding the medical records can provide information about the patient in the isolating cabin 1 for medical staffs, and the records should be kept with the patient.

Figure 5:
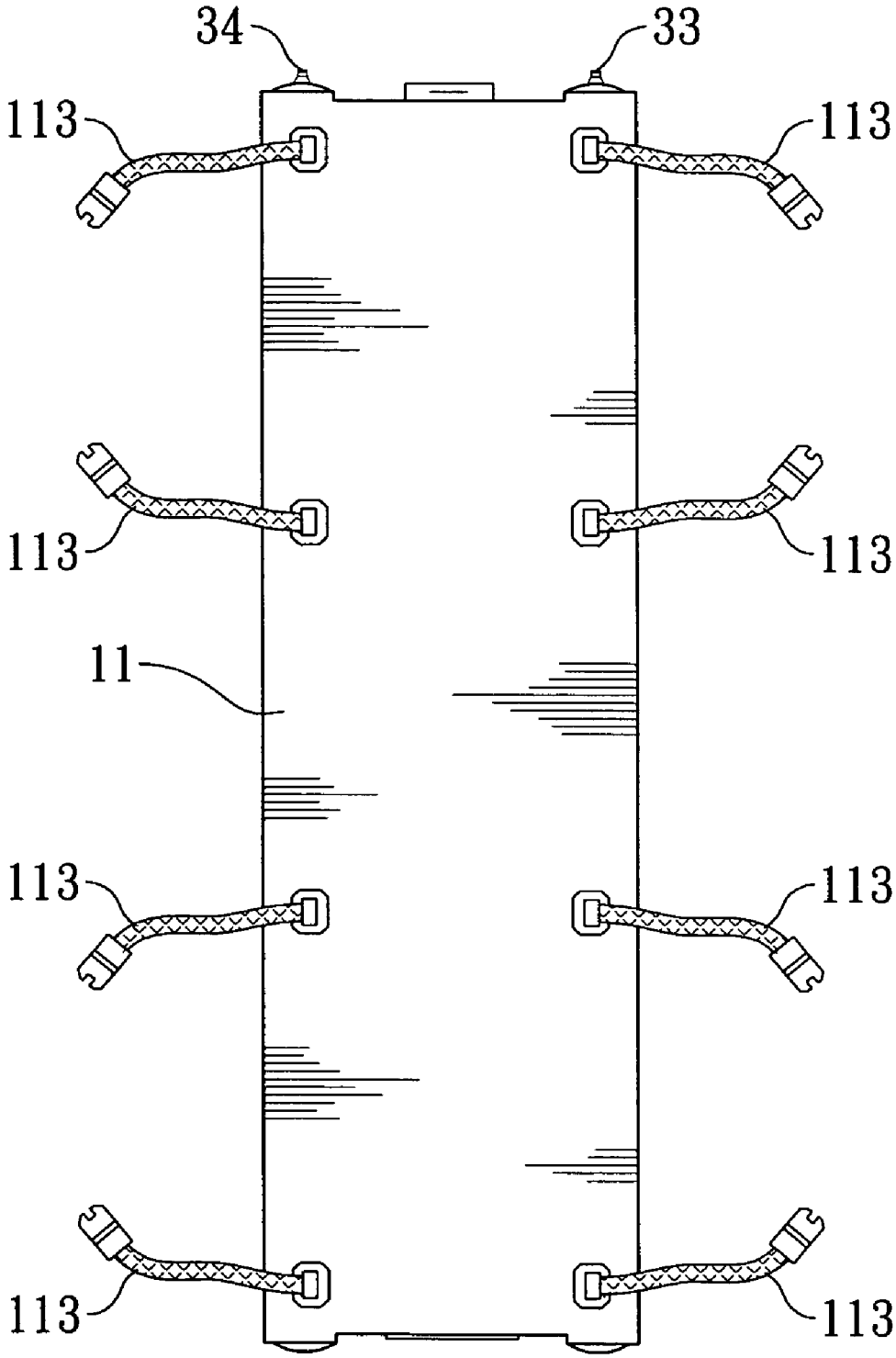
FIG. 5 is a schematic rear view of a base of the preferred embodiment of the present invention.
Figure 6:
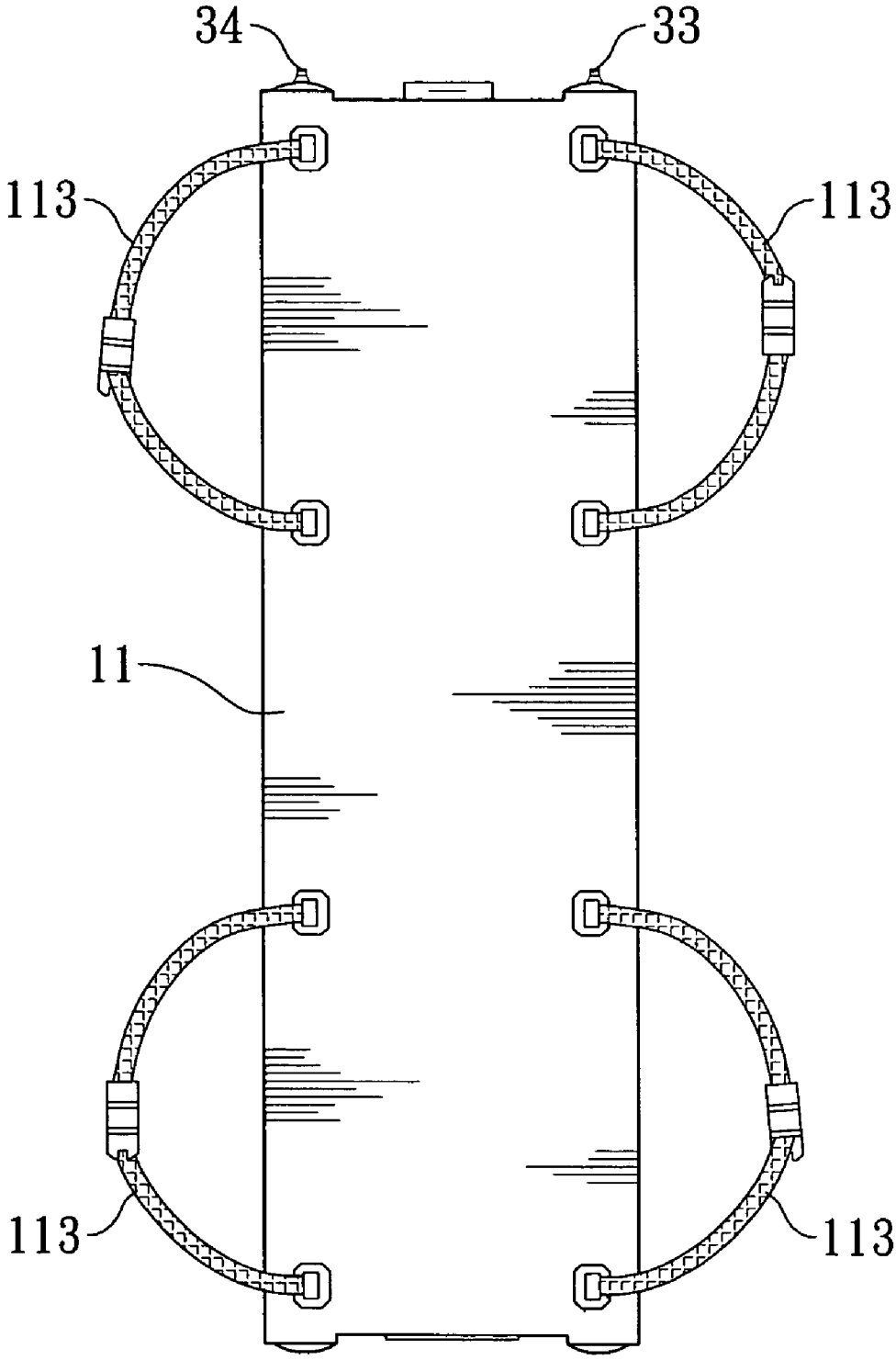
FIG. 6 is another schematic rear view of the base of the preferred embodiment of the present invention.

Referring to FIGS. 5 and 6, the base 11 of the present invention is provided on its lateral side with a plurality of fixing tapes 113 for fixing on a litter or a sick bed 2 for the convenience of moving. The present invention has the very tough base 11 that can be used directly without a litter; it needs only to make mutual engagement of the fixing tapes 113 to form loop belts in order that people can pull directly the loop belts for moving the inflatable isolating cabin 1.

Figure 7:
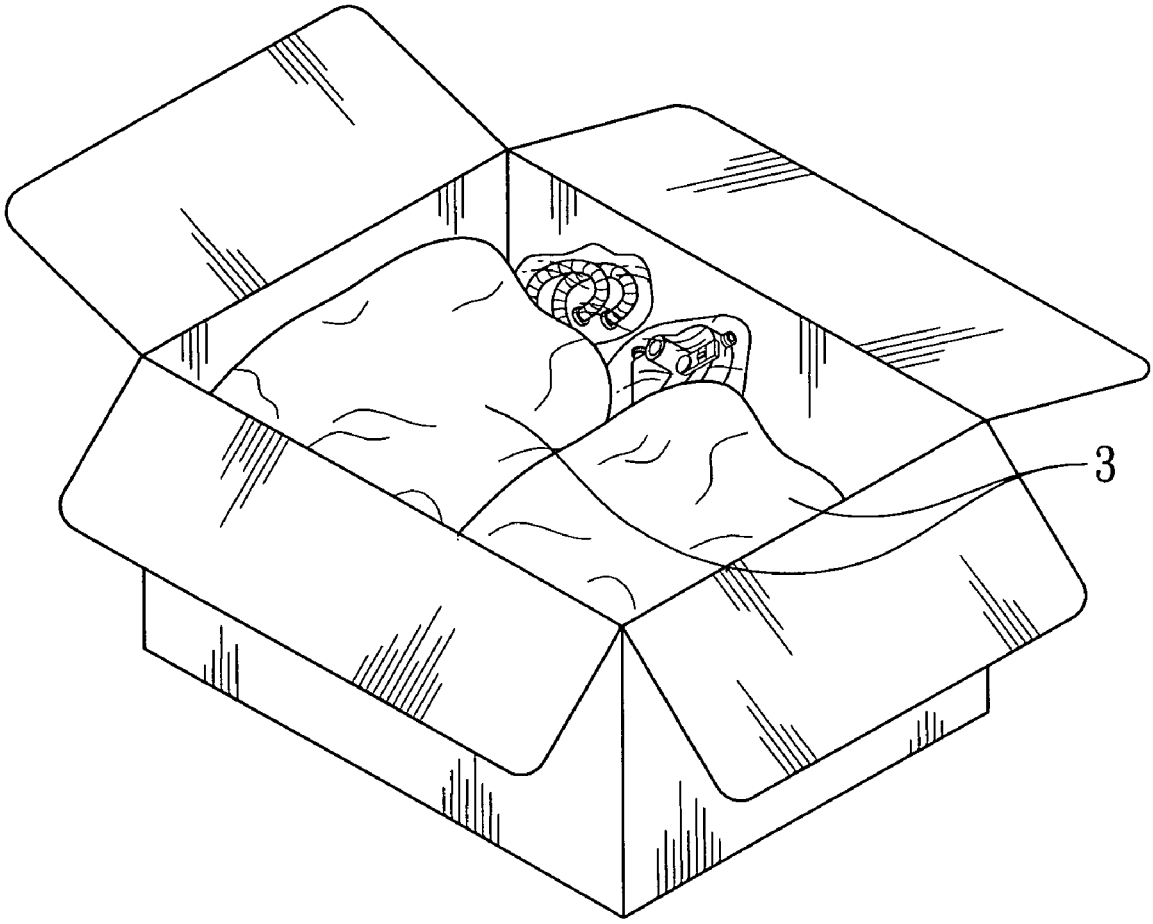
FIG. 7 is a schematic perspective view of the preferred embodiment of the present invention when it is not in use and can be deflated and folded into very small volume.

When the device of the present invention is not in use, as shown in FIG. 7, the inflatable isolating cabin 1 including the outer hood 12, the base 11, and the inflatable supporting structure 13 will be collapsed and received in a receiving bag 3; the remaining parts are received in a plastic bag and the plastic bag is placed together with the receiving bag 3 in a small cardboard box; therefore, the present invention does not take a large space and is convenient for storage.

The present invention is of low cost and can be discarded and destroyed after using for a patient isolated, and thereby it highly meets the requirement of sanitary safety.

The present invention has the following advantages:

1. The isolating cabin of the present invention is completely made of soft material, and its supporting member is an inflatable supporting structure; the present invention does not take a large space and is convenient for storage when it is not in use.
2. The present invention is structurally simple and can be fast mass-produced to meet urgent requirement.
3. The product of the present invention is of low cost and can be discarded and destroyed after being used; thereby it highly meets the requirement of sanitary safety.

The present invention has a very tough base, and is provided with a plurality of fixing tapes to be mutually engaged so that it can be used independently for carrying and transporting patients outdoors.

In conclusion, according to the content disclosed above, the present invention surely provides an inflatable isolating cabin convenient for a patient to be isolated in transportation for medical treatment, and is structurally simple and of low cost.

Having thus described my invention about the value of practicality, what I claim as new and desire to be secured by Letters Patent of the United States is:

1. An inflatable isolating cabin that can be inflated to form a cabin and deflated into a solid form convenient for storage comprising:

a very tough and soft base;

a flexible outer hood provided with at least one air exhausting hole and with at least one air inlet hole, a part of the periphery of said outer hood fixedly connected with said base and the other parts detachably connected with said base;

an inflatable supporting structure connected with an inner side of said outer hood, and provided with at least one inflation inlet hole in order that after inflation of said supporting structure, said outer hood is unfolded to form said cabin;

and a filtering means including an electric air pump and at least one toxicant-filtering can that is connected with an air exhausting hole for filtering toxic gas that is exhausted from said isolating cabin, wherein said outer hood is provided thereon with a plurality of recessed portions in the glove-shaped form extending into said isolating cabin for the convenience of indirect contact with outside medical staffs to do medical treatment for a patient through said glove-shaped recessed portions, wherein the inflatable supporting structure is composed of one top hollow transverse beam, two bottom hollow transverse beams and at least three hollow reverse "U"-shaped posts, wherein at least one front hollow reverse "U"-shaped post and a bottom transverse beam form a first inflatable air chamber, at least one rear hollow reverse "U"-shaped post and the other bottom transverse beam form a second air chamber, at least one hollow reverse "U"-shaped post and the top transverse beam form a third inflatable air chamber, and each of the three inflatable air chambers is independent and separated with each other, and has its own inflation inlet respectively.

2. The inflatable isolating cabin as in claim 1, wherein said inflatable supporting structure and said outer hood are of the same material.

3. The inflatable isolating cabin as in claim 1, wherein said periphery of said outer hood is partly detachably connected with said base by using an airtight zipper.

4. The inflatable isolating cabin as in claim 1, wherein said outer hood and said inflatable supporting structure are integrally formed.

5. The inflatable isolating cabin as in claim 1, wherein said base is made of canvas.

6. The inflatable isolating cabin as in claim 1, wherein said outer hood further is provided with a plurality of connecting holes in tightly connection with medical pipes and lines.

7. The inflatable isolating cabin as in claim 1, wherein said electric air pump has two air drawing tubes, an air exhausting port and at least one chargeable battery; said two air drawing tubes are respectively connected to toxicant-filtering cans that are connected with air exhausting holes of said outer hood to exhaust non-harmful clean air out of said air exhausting port, and said chargeable battery provides electric power for operating said filtering means.

8. The inflatable isolating cabin as in claim 7, wherein said air inlet hole is provided with a filter net.

9. The inflatable isolating cabin as in claim 1, wherein said outer hood is provided on its outer surface with a receiving bag for holding medical records.

10. The inflatable isolating cabin as in claim 1, wherein each of the first and second inflatable air chamber has two hollow reverse "U"-shaped posts.

11. An inflatable isolating cabin that can be inflated to form a cabin and deflated into a solid form convenient for storage comprising:

a very tough and soft base;

a flexible outer hood provided with at least one air exhausting hole and with at least one air inlet hole, a part of the periphery of said outer hood fixedly connected with said base and the other parts detachably connected with said base;

an inflatable supporting structure connected with an inner side of said outer hood, and provided with at least one inflation inlet hole in order that after inflation of said supporting structure, said outer hood is unfolded to form said cabin;

and a filtering means including an electric air pump and at least one toxicant-filtering can that is connected with an air exhausting hole for filtering toxic gas that is exhausted from said isolating cabin, wherein the inflatable supporting structure is composed of one top hollow transverse beam, two bottom hollow transverse beams and at least three hollow reverse "U"-shaped posts, wherein at least one front hollow reverse "U"-shaped post and a bottom transverse beam form a first inflatable air chamber, at least one rear hollow reverse "U"-shaped post and the other bottom transverse beam form a second air chamber, at least one hollow reverse "U"-shaped post and the top transverse beam form a third inflatable air chamber, and each of the three inflatable air chambers is independent and separated with each other, and has its own inflation inlet respectively.

12. The inflatable isolating cabin as in claim 11, wherein each of the first and second inflatable air chamber has two hollow reverse "U"-shaped posts.

* * * * *